US007444768B2

(12) United States Patent
Friton

(10) Patent No.: US 7,444,768 B2
(45) Date of Patent: Nov. 4, 2008

(54) FOOTWEAR AND OTHER SYSTEMS INCLUDING A FLEXIBLE MESH OR BRAIDED CLOSURE SYSTEM

(75) Inventor: Michael R. Friton, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/776,242

(22) Filed: Feb. 12, 2004

(65) Prior Publication Data

US 2005/0178026 A1 Aug. 18, 2005

(51) Int. Cl.
*A43C 11/00* (2006.01)

(52) U.S. Cl. ..... 36/50.1; 36/72 R

(58) Field of Classification Search ..... 36/50.1, 36/72 R, 51, 50.5, 89
See application file for complete search history.

(56) References Cited

U.S. PATENT DOCUMENTS

| | | | | | |
|---|---|---|---|---|---|
| 11,947 | A | | 11/1854 | Pease | |
| 494,598 | A | | 4/1893 | Russell | |
| 757,424 | A | | 4/1904 | Vohl | |
| D47,238 | S | | 4/1915 | Miller | |
| 1,258,629 | A | | 3/1918 | Bliss | |
| 1,382,748 | A | * | 6/1921 | Slasor | 36/72 R |
| 1,582,232 | A | * | 4/1926 | Vinzant | 36/72 R |
| 1,663,319 | A | | 3/1928 | Snell | |
| 1,730,768 | A | * | 10/1929 | Heyman | 87/8 |
| 1,900,515 | A | | 3/1933 | Miller | |
| 1,952,294 | A | | 3/1934 | Strauss | |
| 1,982,906 | A | * | 12/1934 | Dawes | 36/50.1 |
| 2,015,479 | A | | 9/1935 | Koomrulan | |
| 2,160,768 | A | | 5/1939 | Wasser | |
| 2,392,867 | A | | 1/1946 | Stoner et al. | |
| 2,657,477 | A | * | 11/1953 | Winslow | 36/2 R |
| 2,836,909 | A | | 6/1958 | Richards | |
| 3,102,347 | A | | 9/1963 | Griswold et al. | |
| 3,175,311 | A | | 3/1965 | MacQuaid | |
| 4,231,170 | A | | 11/1980 | Griswold | |
| 4,486,965 | A | | 12/1984 | Friton | |
| 4,656,761 | A | | 4/1987 | Lord | |
| 4,677,767 | A | | 7/1987 | Darby | |
| 4,845,864 | A | * | 7/1989 | Corliss | 36/131 |
| 4,908,963 | A | | 3/1990 | Krajcir et al. | |
| 4,972,610 | A | | 11/1990 | Tong | |

(Continued)

FOREIGN PATENT DOCUMENTS

| | | |
|---|---|---|
| WO | WO 95/22917 | 8/1995 |

*Primary Examiner*—Ted Kavanaugh
(74) *Attorney, Agent, or Firm*—Banner & Witcoff, Ltd.

(57) ABSTRACT

Systems for securing a foot in a housing such as a piece of athletic footwear, include: (a) a foot-housing member that at least partially defines a chamber for receiving the foot (e.g., a shoe upper and/or insole and/or outsole and/or midsole); and (b) a closure system for holding the foot in the foot-housing member. The closure system may include a mesh or braided panel that at least partially holds the foot-receiving device on the foot. The mesh or braided panel may conform to foot shape or position changes while still maintaining adequate pressure on the foot and/or adequately closing the chamber opening to hold the foot in the housing member. This closure system may operate in conjunction with a secondary closure system, such as a shoelace arrangement, a strap arrangement, a hook-and-loop fastener arrangement, a hook-and-eyelet fastener arrangement, an elastic band arrangement, a zipper arrangement, or the like.

25 Claims, 6 Drawing Sheets

U.S. PATENT DOCUMENTS 5,065,531 A 11/1991 Prestridge
5,144,759 A 9/1992 Mascotte
5,272,822 A * 12/1993 Diaz ..... 36/2 R
5,288,150 A * 2/1994 Bearman ..... 383/38
5,337,491 A 8/1994 Mascotte
5,365,677 A 11/1994 Dalhgren
5,467,537 A 11/1995 Aveni et al.
5,497,564 A 3/1996 Allen et al.
5,659,982 A 8/1997 Muraoka et al.
5,678,325 A 10/1997 Davidowitz et al.
5,692,319 A * 12/1997 Parker et al. ..... 36/50.1
5,694,703 A * 12/1997 Diaz ..... 36/7.1 R
5,701,688 A 12/1997 Crowley
5,704,138 A 1/1998 Donnadieu
5,765,296 A 6/1998 Ludemann et al.
5,878,511 A 3/1999 Krajcir
5,926,978 A 7/1999 Smith
5,992,057 A * 11/1999 Monti ..... 36/89
6,018,890 A 2/2000 Bowen
6,021,585 A * 2/2000 Cole ..... 36/11.5
6,029,376 A 2/2000 Cass
6,049,955 A 4/2000 Bowen
6,052,921 A 4/2000 Oreck
6,088,936 A 7/2000 Bahl
6,237,250 B1 5/2001 Aguerre
6,289,558 B1 9/2001 Hammerslag
6,295,704 B1 10/2001 Rivas
6,367,168 B1 4/2002 Hatfield et al.
6,457,260 B1 10/2002 Roelofs
6,477,754 B1 11/2002 Alexander
D467,708 S 12/2002 Portzline
6,505,424 B2 1/2003 Oorei et al.
6,532,687 B2 * 3/2003 Towns et al. ..... 36/11.5
6,594,918 B2 7/2003 Hatfield et al.
6,601,323 B2 8/2003 Tsujino et al.
6,857,204 B1 * 2/2005 Davis et al. ..... 36/50.1
6,880,270 B2 * 4/2005 Prather ..... 36/50.1
6,922,917 B2 * 8/2005 Kerns et al. ..... 36/50.1
2002/0124436 A1 9/2002 Hatfield et al.

* cited by examiner

FOOTWEAR AND OTHER SYSTEMS INCLUDING A FLEXIBLE MESH OR BRAIDED CLOSURE SYSTEM

FIELD OF THE INVENTION

Aspects of the present invention relate generally to systems and methods for securing objects in housing members, such as systems and methods for securing apparel to a wearer's body. In one more specific example aspect, the invention relates to systems and methods for securing a foot in a foot-receiving device, such as a piece of footwear. In at least some examples, at least a portion of the closure systems according to the invention may conform to object shape or position changes while still maintaining adequate pressure on the object and/or closure of the housing member to hold the object in the housing member.

BACKGROUND

Conventional footwear typically attaches to a wearer's foot via laces, buckles, straps, hook-and-loop fasteners, elastic bands, zippers, and the like. While effective, these types of closure systems can be difficult for some to use. For example, some people can have difficulty tying shoelaces, e.g., because of a lack of finger dexterity, arthritis or other conditions, or the like. Additionally, some people can have difficulty operating the small mechanisms typically associated with buckles and zippers used on shoes.

Other problems can exist in the use of conventional shoe closure systems like those described above. For example, shoelaces, straps, buckles, zippers, and the like can inadvertently loosen while in use, resulting in safety hazards for wearers, e.g., from tripping, unexpected shoe loss, etc. This is a particular hazard for athletic footwear used in competition.

Additionally, conventional shoe closure systems like those described above are dramatically visible in the final footwear product. To some, shoelaces, straps, buckles, and zippers are not aesthetically pleasing, at least in some desired shoe designs. Hook-and-loop fasteners tend to collect threads and other debris, which can detract from the appearance of the shoe. Moreover, the need to use these conventional shoe closure systems can limit the creativity of designers in producing new footwear product designs.

Accordingly, it would be advantageous to provide an alternative closure system that is easy and quick to use and that could securely hold an object in a housing member. Additionally, in some more specific examples, it would be advantageous to provide an alternative apparel closure system that is quick and easy to use, that can securely hold apparel on a wearer's body (such as holding a wearer's foot in a foot-receiving device (such as footwear, bindings, clips, and the like)), and optionally, that could be used both with and without conventional closure systems. Additionally, in at least some instances, it would be advantageous to provide a closure system for a foot-engaging device that provides a smoother and sleeker exterior footwear appearance.

SUMMARY

Aspects of the present invention relate to systems and methods for securing objects in housing members. Such systems may include, for example: a housing member that at least partially defines a chamber for receiving an object to be secured; and a closure system for holding the object in the housing member, wherein the closure system includes a mesh or braided panel for at least partially holding the object within the housing member, wherein the mesh or braided panel at least partially extends around the housing member and conforms, at least to some extent, to object shape or position changes. In at least some examples, the mesh or braided panel may completely extend around the housing member and/or the object being held. Example methods according to aspects of the invention may include: (a) inserting at least a portion of an object into an opening defined in a housing member; (b) placing a closure system adjacent to at least a portion of the opening, wherein the closure system includes a mesh or braided panel that at least partially holds the object in the housing member, wherein the mesh or braided panel at least partially extends around the housing member and, to at least some extent, conforms to object shape or position changes; and (c) securing the closure system to hold the object in the housing member.

Additional and more specific aspects of at least some examples of this invention relate to systems for securing apparel to a wearer's body, e.g., systems that secure a foot in a foot-receiving device, such as a piece of footwear. Foot-receiving devices according to at least some examples of this invention may include: (a) a foot-housing member that at least partially defines a chamber for receiving a foot; and (b) a closure system for holding the foot in the foot-housing member. The closure system may include a mesh or braided panel that at least partially holds the foot-receiving device on the foot, as generally described above.

Methods for securing a foot-receiving device to a foot according to at least some examples of this invention may include: (a) inserting a foot through an opening defined in a foot-housing member of a foot-receiving device; (b) placing a closure system adjacent to at least a portion of the opening, wherein the closure system includes a mesh or braided panel for at least partially holding the foot-receiving device on the foot; and (c) securing the closure system to hold the foot in the foot-housing member.

The mesh or braided panel, in at least some examples of systems and methods according to the invention, may be flexible such that it conforms to object shape or position changes, to at least some degree, while still maintaining adequate pressure on the object and/or closure of the housing member to hold the object in the housing member. Additionally, the closure system including the mesh or braided panel may operate in conjunction with a secondary closure system or securing system, such as a shoelace or other tie arrangement, a strap arrangement, a hook-and-loop fastener arrangement, an elastic band arrangement, a zipper arrangement, or the like.

Foot-receiving devices according to at least some examples of the invention may include footwear, such as athletic footwear. The foot-housing member, at least in part, may be defined by the shoe upper and/or the shoe sole and/or the shoe insole. The closure system may form an integral part of the shoe, such as a portion of the upper. Closure systems in accordance with aspects of the invention also may be used to secure other types of apparel on a body, such as, gloves, shirts, blouses, pants, shorts, skirts, coats, jackets, etc.

BRIEF DESCRIPTION OF THE DRAWINGS

The above and other objects, features, and advantages of the present invention will be more readily apparent and more fully understood from the following detailed description, taken in connection with the appended drawings, in which.

DETAILED DESCRIPTION

Figure 1:
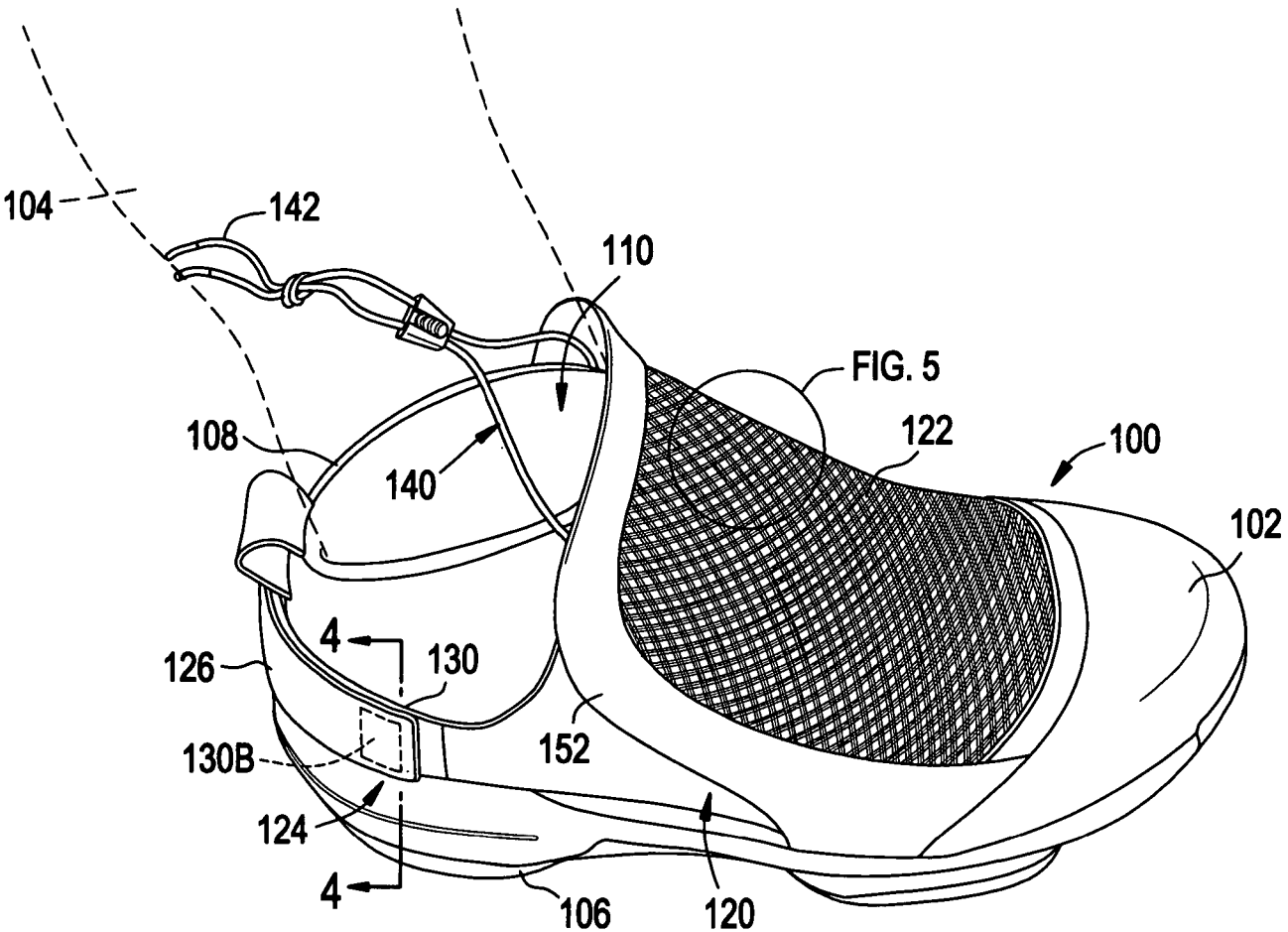
FIGS. 1 and 2 illustrate various features of a first example of systems and methods according to this invention.

Various specific examples of the invention are described in detail below in conjunction with the attached drawings. To assist the reader, this specification is broken into various subsections, as follows: Terms; General Description of a Closure System; Specific Examples of the Invention; and Conclusion.

A. Terms

The following terms are used in this specification, and unless otherwise noted or clear from the context, these terms have the meanings provided below.

"Foot-receiving device" means any device into which a wearer places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise bikes, games, and the like; bindings, clips, or other devices for receiving feet during play of video games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, ski boots, etc.), and the like.

B. General Description of a Closure System

In general, aspects of this invention relate to systems and methods for securing objects in housing members. Such systems may include: a housing member that at least partially defines a chamber for receiving an object to be secured; and a closure system for holding the object in the housing member. The closure system may include a mesh or braided panel for at least partially holding the object within the housing member, wherein the mesh or braided panel at least partially extends around the housing member and, to at least some degree, conforms to object shape or position changes. The mesh or braided panel may be formed from a plurality of plastic strands in a braided and/or mesh arrangement, to thereby provide a strong and flexible closure structure. Methods according to examples of the invention may include: inserting at least a portion of an object into an opening defined in a housing member; placing a closure system adjacent to at least a portion of the opening, wherein the closure system includes a mesh or braided panel as generally described above; and securing the closure system to hold the object in the housing member. More specific aspects of the invention may relate to systems for holding apparel on a wearer's body (e.g., the "object" is a body part and the "housing member" is a piece of apparel).

The closure system further may include a securing device or system that keeps the mesh or braided panel proximate to and/or engaged with the housing member.

The securing device or system may take on any desired or suitable form without departing from the invention. For example, the securing device or system may include at least one strap that extends at least partially around a portion of the housing member, wherein the strap secures to another portion of the strap, to another portion of the closure system, to the housing member, to a base member, or the like. The closure system may be secured using any suitable or desired securing system or fastener arrangement, such as via magnetic engagement, via a hook-and-loop fastener arrangement, via a belt buckle type fastener arrangement, via a hook-and-eyelet type fastener arrangement, via an elastic band or strap arrangement, via a tie down arrangement, or the like.

In at least some examples, the closure system may be one of a plurality of closure systems available for use with the housing member. For example, the closure system described above may be a primary closure system used or present on a housing member in conjunction with a secondary closure system, which can take on any suitable or desired form without departing from the invention. Examples of secondary closure systems that may be used in combination with closure systems including the mesh or braided panel according to at least some examples of this invention may include: a tie down or lace type closure system, a strap type closure system (such as a buckle arrangement or the like), a hook-and-loop fastener type closure system, an elastic band type closure system, a hook-and-eyelet fastener type closure system, a zipper type closure system, and/or the like. In at least some examples of the invention, when the mesh or braided closure system is used in combination with a secondary closure system, the mesh or braided closure system may at least partially cover the secondary closure system, e.g., to help prevent the secondary closure system from loosening and/or to prevent unwanted exposure of the secondary closure system.

More specific examples of at least some aspects of this invention relate to systems for securing a foot in a foot-receiving device. Foot-receiving devices according to at least some examples of this aspect of the invention may include: (a) a foot-housing member that at least partially defines a chamber for receiving a foot; and (b) a closure system for holding the foot in the foot-housing member. This closure system, in at least some examples of the invention, may include a mesh or braided panel that at least partially holds the foot-receiving device on the foot, wherein the mesh or braided panel at least partially extends around the foot-housing member and, to at least some degree, conforms to foot shape or position changes.

Some examples of this invention relate to pieces of footwear, such as athletic footwear, that include closure systems like those described above. Such pieces of footwear may include: (a) a sole member; (b) an upper member extending from the sole member and at least partially defining a chamber for receiving a foot; and (c) a closure system for holding the foot in the piece of footwear, wherein the closure system includes a mesh or braided panel for at least partially holding the piece of footwear on the foot, wherein the mesh or braided panel at least partially extends around the upper member and, to at least some degree, conforms to foot shape or position changes. The piece of footwear may have various constructions and features, including, for example, the various constructions and features of the closure system, the fastener arrangement, and/or the secondary closure system, like those described above.

Additional aspects of this invention relate to methods for securing a foot in a foot-receiving device, such as a piece of footwear. Such methods may include, for example: (a) inserting a foot through an opening defined in a foot-housing member of a foot-receiving device; (b) placing a closure system adjacent to at least a portion of the opening, wherein the closure system includes a mesh or braided panel for at least partially holding the foot-receiving device on the foot, wherein the mesh or braided panel at least partially extends around the foot-housing member and, to at least some degree, conforms to foot shape or position changes; and (c) securing the closure system to hold the foot in the foot-housing member. Again, the foot-receiving device may take on various constructions and have various features, including, for example, the various constructions and features of the closure system, the fastener arrangement, and/or the secondary closure system, like those described above.

Specific examples of the invention are described in more detail below. The reader should understand that these specific examples are set forth merely to illustrate examples of the invention, and they should not be construed as limiting the invention.

C. Specific Examples of the Invention

The various figures in this application illustrate examples of closure systems useful in systems and methods according to examples of this invention. When the same reference number appears in more than one drawing, that reference number is used consistently in this specification and the drawings to refer to the same part throughout.

FIG. 1 illustrates an example system 100 for securing an object in a housing member in which the housing member is in the form of a piece of footwear 102 for receiving a wearer's 104 foot (e.g., a piece of athletic footwear). The piece of footwear 102 includes a sole member 106 (an outsole is illustrated in FIG. 1) attached to an upper member 108. The upper member 108 may be attached to the sole member 106 in any suitable or desired manner, including in conventional manners well known and understood by those skilled in the art. The upper member 108 provides or defines an opening 110 through which a wearer 104 can insert his/her foot for receipt in the chamber defined by the upper member 108 and an insole member (not shown). The upper member 108 may be constructed from leather, vinyl, and/or other materials including conventional materials well known to those skilled in the art. Likewise, the sole member 106 may be constructed from leather, rubber, and/or other materials, including conventional materials well known to those skilled in the art.

The piece of footwear 102 further includes a closure system 120 for, at least partially, holding the foot in the chamber of the piece of footwear 102. In the example illustrated in FIG. 1, the closure system 120 includes a mesh or braided panel 122 that at least partially extends around the upper member 108 and over the top instep portion of the wearer's foot and the upper member 108 (see also FIGS. 2, 3 and 7), to secure or help secure the foot in the piece of footwear 102. The mesh or braided panel 122 is flexible such that, to at least some degree, it can conform to foot shape or positional changes while still securing or helping to secure the foot in the piece of footwear 102. This panel 122 and/or the border 152 surrounding it may be formed from polymeric materials, from materials used in forming the upper member 108 or sole member 106, and/or from other suitable materials without departing from this invention. In some examples, the panel 122 may completely extend around the piece of footwear, the foot, and/or other object being held.

Figure 2:
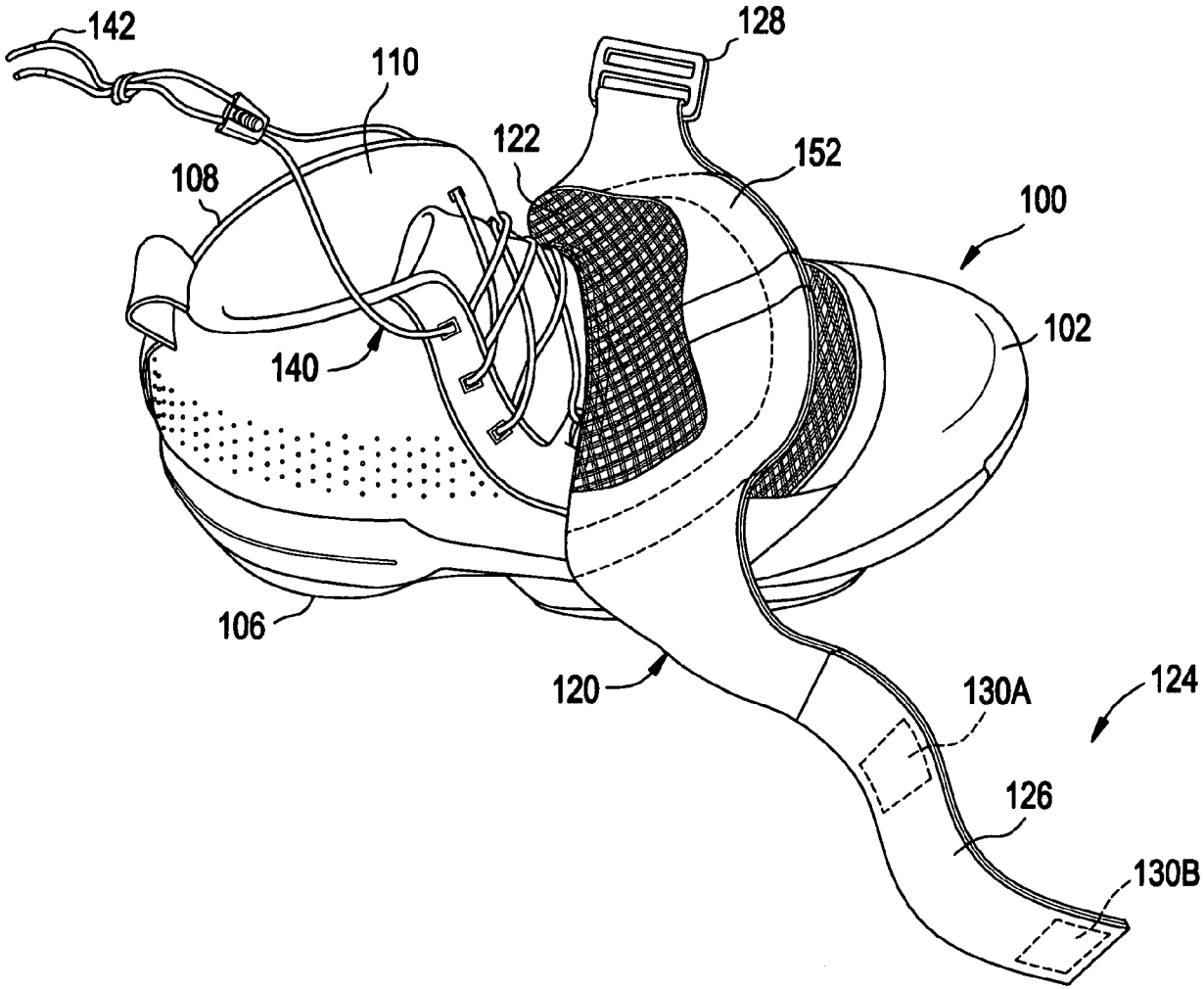

In the illustrated example, and as also illustrated in FIG. 2, the closure system 120 further includes a securing device 124 that helps maintain the mesh or braided panel 122 proximate to and/or engaged with the upper member 108. In the illustrated example, the securing device 124 includes a strap 126 integrally provided with and extending from the mesh or braided panel 122. In use, the strap 126 extends from the side of the piece of footwear 102, around its back heel portion, through a buckle member 128, and secures to itself, e.g., through a magnetic fastener arrangement 130 (magnets 130A and 130B shown in FIG. 2). If necessary or desired, one or more belt loops may be provided along the upper member 108 (or another suitable location) to help hold the strap 126 in place (e.g., a loop provided at the back heel portion of the upper member 108).

The securing device 124 may take on any suitable or desired form without departing from the invention. For example, the securing device 124 may include a hook-and-loop fastener arrangement, a conventional belt buckle type arrangement, a hook-and-eyelet fastener arrangement, or the like. Additionally, the securing device 124 need not secure to itself. For example, a strap of a securing system may secure to another element provided on the upper member 108 and/or the sole member 106 without departing from the invention (e.g., a portion of the magnetic fastener arrangement and/or a hook-and-loop type fastener arrangement and/or a hook-and-eyelet type fastener arrangement could be provided at a suitable location on the upper member 108 and/or sole member 106 rather than as part of the strap 126). Optionally, in at least some examples, the buckle member 128 may be omitted without departing from the invention (e.g., individual straps, laces, ties, or the like, extending from each side of the mesh or braided panel 122 may secure to one another, to the upper member 108, and/or to the sole member 106 without departing from the invention). Other suitable fastener arrangements or securing systems 124 also are possible.

The example system 100 illustrated in FIGS. 1 and 2 further illustrates that the piece of footwear 102 may include a secondary closure system 140 to assist in holding the wearer's 104 foot in the piece of footwear 102. In the illustrated example, this secondary closure system 140 includes a conventional shoe lace arrangement. As shown, the primary closure system 120 may at least partially cover the secondary closure system 140 when the primary closure system 120 is engaged and the piece of footwear 102 is secured to the wearer's 104 foot. Optionally, if desired, the wearer 104 may tuck the entire lace 142 (and any associated clips or mechanisms) under the mesh or braided panel 122 when securing the primary closure system 120 such that the laces are not visible and/or such that the laces will not become entangled with the wearer's feet or another party's feet, even if the laces inadvertently become untied.

Of course, any other suitable or desired secondary closure system 140 may be used without departing from the invention, including closure systems that include buckles, straps, hook-and-loop fasteners, hook-and-eyelet fasteners, elastic bands, zippers, and the like. Additionally, the secondary closure system 140, when present, need not be located immediately beneath the mesh or braided panel 122. Rather, all or some of the secondary securing system 140 may be located along the side of the upper member 108, outside of the primary closure system 120, at the back or heel portion of the upper member 108, and/or at any other suitable or desired location.

Figure 3:
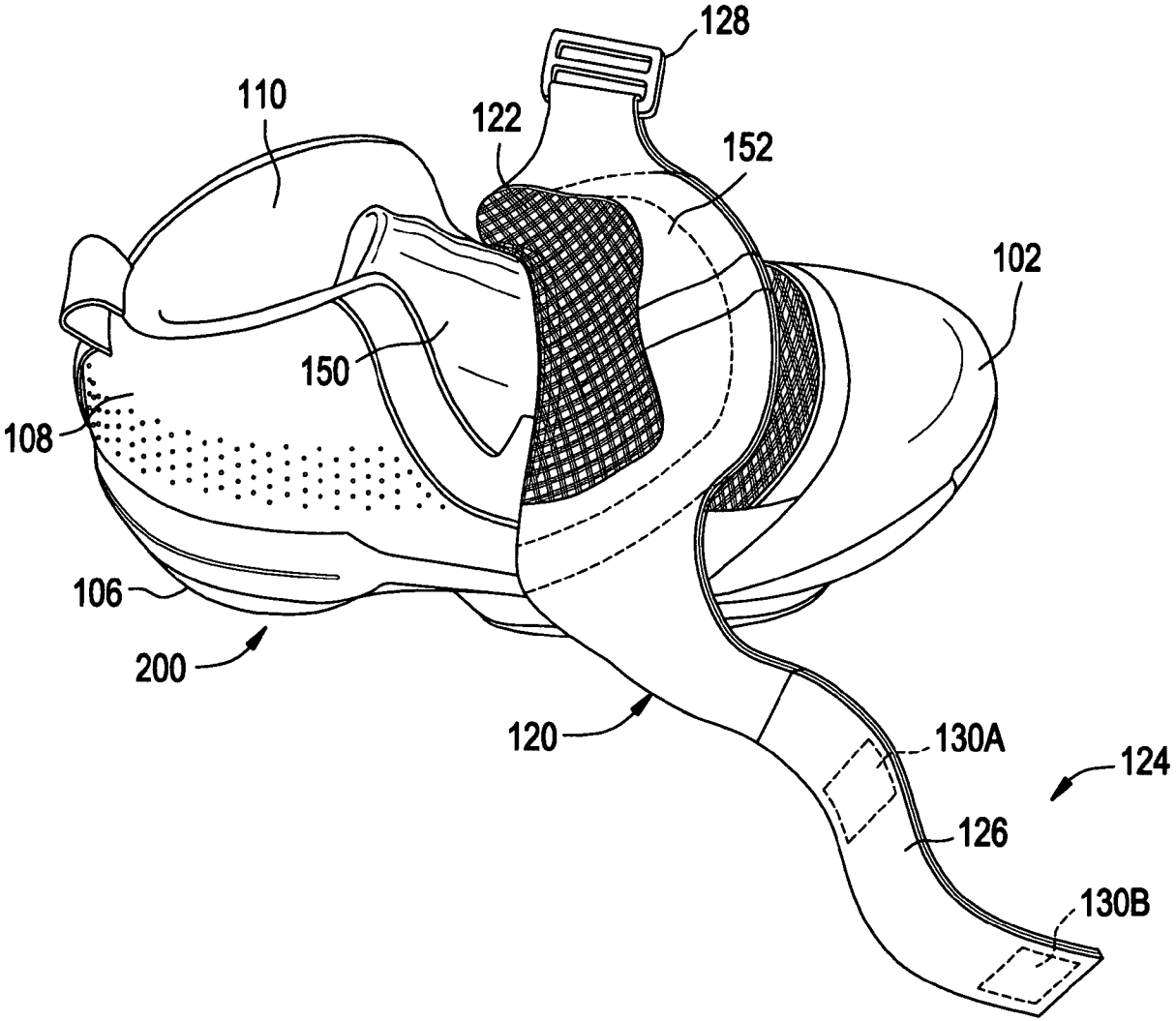
FIG. 3 illustrates various features of a second example of systems and methods according to this invention.

FIG. 3 illustrates an alternative example of a system 200 for securing an object in a housing member. Again, in this example, the illustrated housing member is in the form of a piece of footwear 102 for receiving a wearer's foot (such as a piece of athletic footwear). In this example, the primary closure system 120 remains the same or essentially the same as the example illustrated in FIGS. 1 and 2, so a detailed explanation of these features is not repeated here (the same reference numbers are used as in FIGS. 1 and 2, to make identification of the various parts easy). In this example system 200, however, no secondary closure system is present. This example piece of footwear 102 includes a conventional shoe tongue member 150, but the primary closure system 120 (including the mesh or braided panel 122, strap 126, and buckle member 128) is the sole system for holding the wearer's foot in the piece of footwear 102.

The closure system 120 may be formed in any suitable or desired manner without departing from the invention. In the examples illustrated in FIGS. 1-3, the primary closure system 120 is attached securely as part of the attachment between the sole member 106 and the upper member 108. Of course, the primary closure system 120 may be attached to the sole member 106 and/or the upper member 108 or independent from these members in any suitable manner without departing from the invention, e.g., by stitching, laser welding, heat welding, integral formation, adhesives, or the like.

Figure 4:
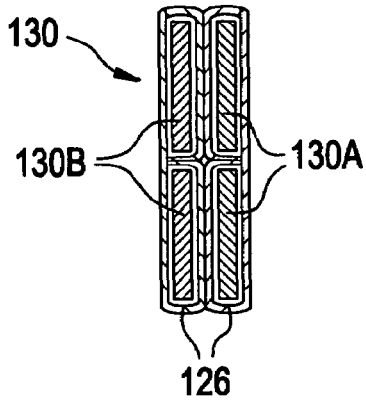
FIG. 4 illustrates a cross sectional view of an example fastener system useful in at least some example systems and methods according to this invention.

FIG. 4 illustrates a cross-sectional view taken along lines 4-4 in FIG. 1 to help illustrate an example magnetic fastener or engagement system 130 used in at least some examples of the invention. As shown in FIGS. 1-3, the magnetic fastener system 130 of this example includes a first set of one or more magnets 130A provided in a pocket or chamber defined in a body portion of the strap 126 and a second set of one or more magnets 130B provided in a pocket or chamber defined at the distal end of the strap 126. In use, as shown also in FIG. 4, the buckle member 128 engages the strap 126 between the sets of magnets 130A and 130B such that the second set of magnets 130B folds over and back onto the first set of magnets 130A to secure the fastener system 130 and thereby secure the closure system 120 on the foot (or other object being secured). The location and arrangement of the magnet sets may be varied without departing from the invention.

Of course, the fastener system 130 need not include two sets of magnets as illustrated in FIGS. 1-4. For example, fastener set 130A may include one or more magnets while fastener set 130B may include a metal material to which a magnet will attract (or vice versa). As another example alternative, the fastener system 130 may include one or more hook-and-loop type fasteners and/or hook-and-eyelet type fasteners such that fastener set 130A includes the loop and/or eyelet portions of the fastener and fastener set 130B includes the hook portions of the fastener (or vice versa). As still another example alternative, the fastener system may include a conventional belt buckle type arrangement such that there is no need for the distal end of strap 126 to overlap the body portion of the strap 126. Other securing or fastening arrangements are possible without departing from the invention.

Figure 5:
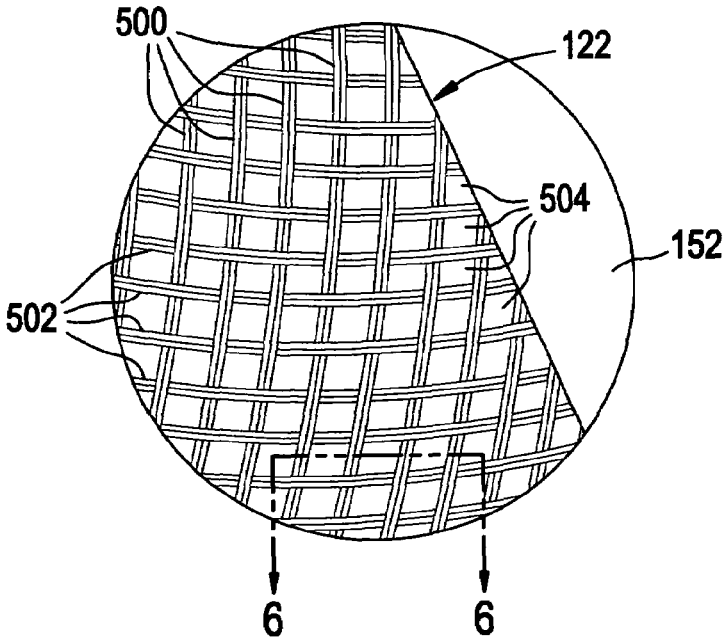
FIGS. 5 and 6 provide magnified and more detailed views of a mesh panel useful in accordance with some examples of this invention.
Figure 6:
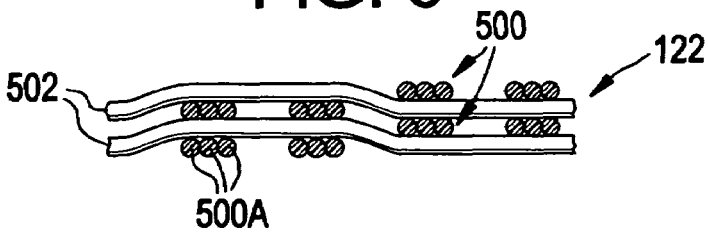

FIGS. 5 and 6 provide more detailed and magnified views of a mesh panel 122 useful in a closure system 120 according to at least some examples of this invention. As shown in FIG. 5 (an enlarged view of a portion of panel 122 of FIG. 1), a mesh panel 122 includes a plurality of polymeric (e.g., nylon) strands 500 running in substantially a first direction and a plurality of plastic strands 502 running in substantially a second direction, wherein the second direction is substantially orthogonal to the first direction. The illustrated mesh structure produces open areas 504 between the various strands. The strands 500 running in the first direction need not be parallel with one another, and likewise, the strands 502 running in the second direction need not be parallel with one another. Additionally, the strands 500 need not be orthogonal with respect to strands 502. Rather, as shown in FIG. 5, the angles of various strands may vary from strand to strand, and the individual strands may be curved in a three dimensional manner and at a variety of angles with respect to one another. Optionally, if desired, plural strand sets 500 or 502 may be braided together to form a braided structure.

The mesh structure of panel 122 allows the panel 122 to be flexible so as to easily conform to different shapes contained within the housing member, as well as to accommodate foot (or other object) shape and/or positional changes. Nonetheless, while flexible and shape conforming, the mesh panel 122 still securely maintains the foot (or other object) in place within the piece of footwear 102 (or other housing member), either with or without a secondary closure system present.

Figure 8:
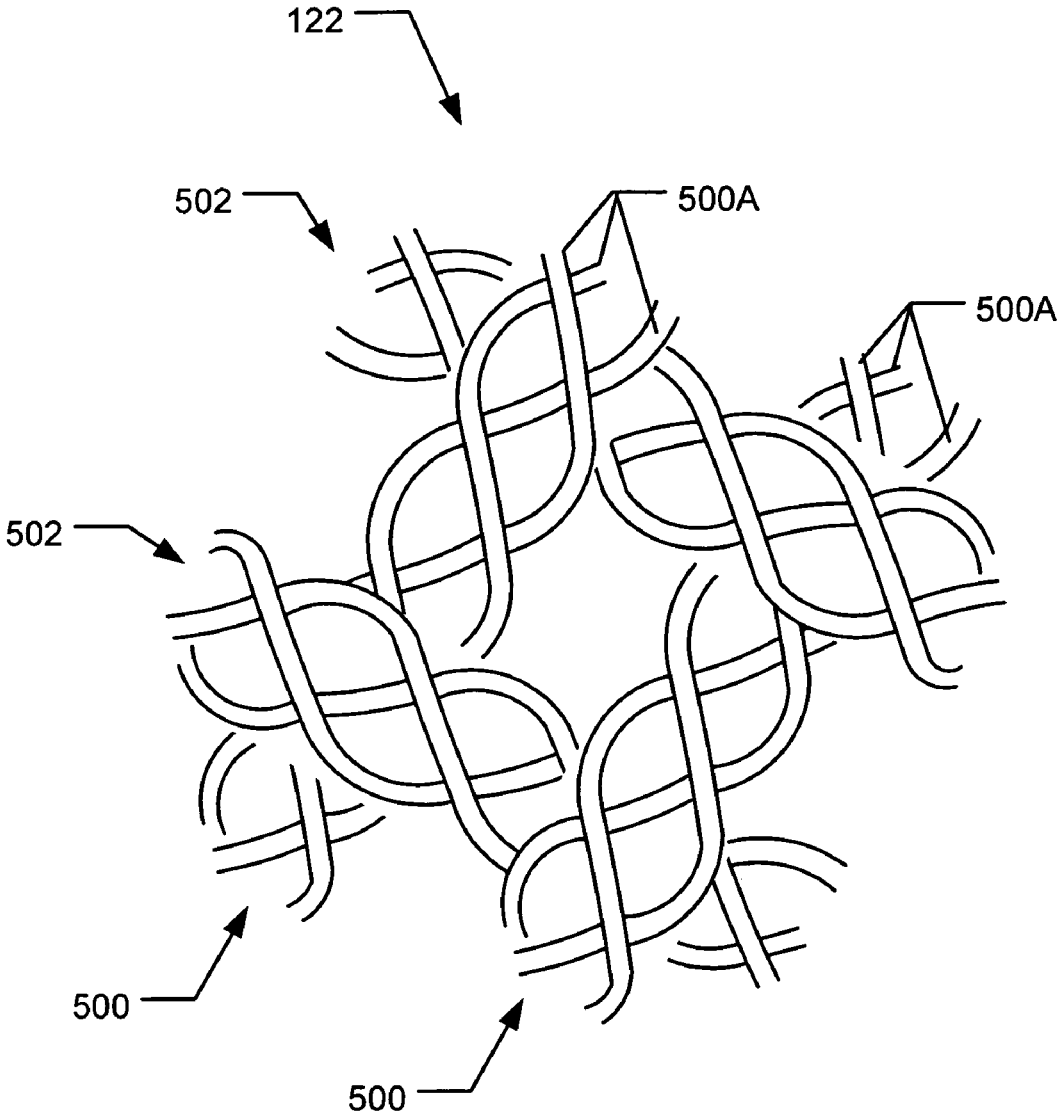
FIG. 8 illustrates an enlarged view of a portion of a braided panel useful in accordance with some examples of this invention.

FIG. 6 illustrates another feature of a mesh panel 122 that may be used according to at least some examples of this invention. As shown, each "strand" 500 may be made up of a plurality of individual strands 500A located closely adjacent to one another, optionally in a braided structure, as also shown in FIG. 8. Of course, the "strands" 502 also may be made of plural individual strands, if desired. This structure provides great strength to the overall mesh panel 122 while allowing good flexibility and conformity, at least to some degree, to shape and/or positional changes, as described above.

Figure 7:
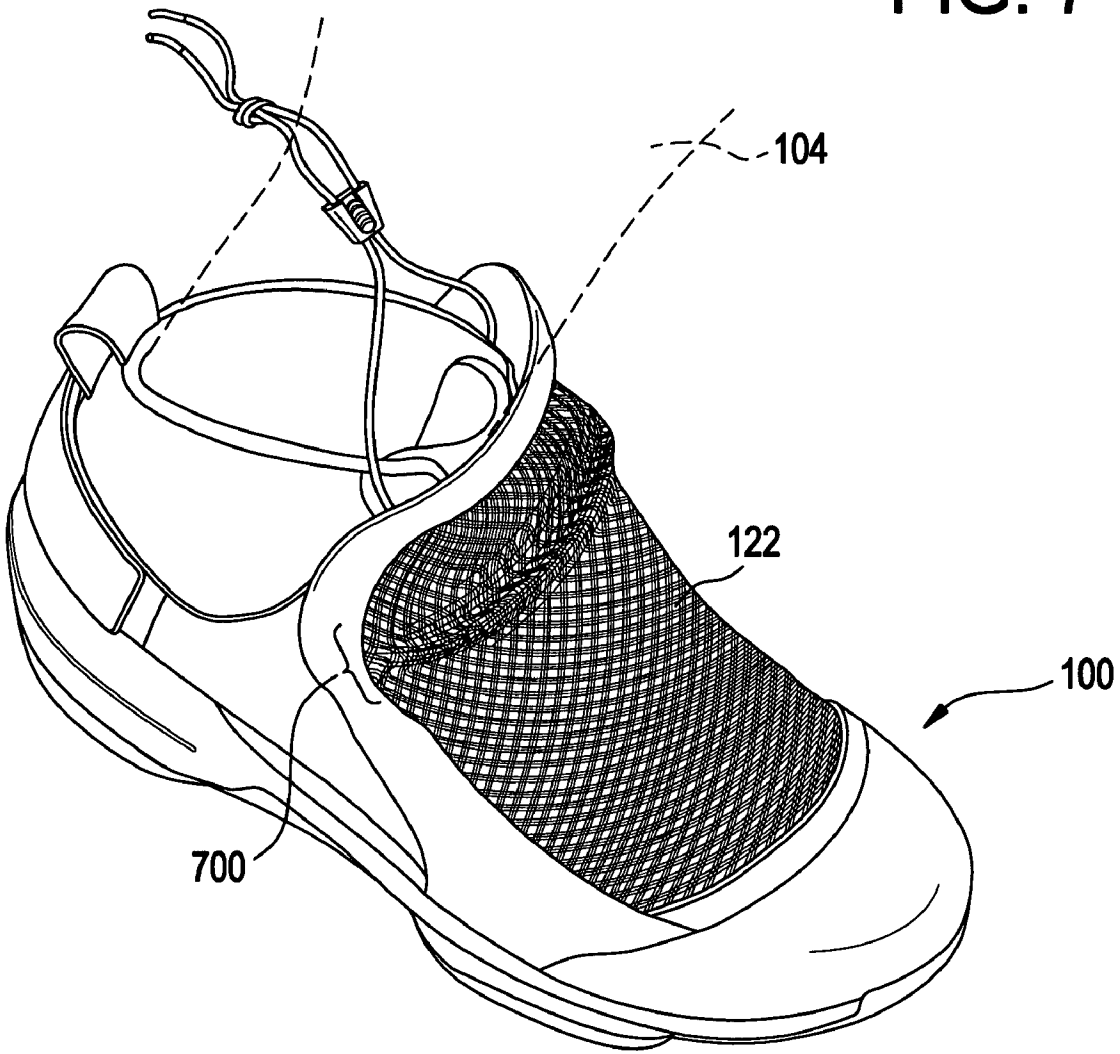
FIG. 7 illustrates the flexibility of a mesh panel useful in some examples of this invention.

FIG. 7 more clearly illustrates the flexibility provided by the mesh or braided panel 122 in accordance with at least one example of this invention. In particular, FIG. 7 illustrates an example of a shoe 100 like that illustrated in FIGS. 1 and 2 in use, e.g., in a position in which a wearer 104 is about to begin running or walking, is in the process of running or walking, is about to jump, or is landing from a jump. As evident from a comparison with FIG. 1, the wearer's 104 leg is moved forward in the example of FIG. 7 (bent forward at the ankle), which causes the mesh panel 122 to flex and compress to accommodate the positional change. More specifically, in the flex region 700 of the mesh panel 122, the mesh material compresses and/or bunches up somewhat in the shoe back-to-front direction, and it may expand somewhat in the shoe side-to-side direction, to accommodate the bending action at the wearer's 104 ankle.

Arranging the mesh panel 122 such that the wearer's ankle or leg generally applies compressive force at a corner of the open spaces 504 (as opposed to along a flat edge of the open spaces 504 and/or generally perpendicular to a set of strands of the mesh or the braids), further enhances the flexibility of the mesh while still maintaining a comfortable and secure fit. Additionally, producing the strands 500 and 502 and/or other elements of the mesh panel 122 from a polymeric material (such as nylon) provides a strong but flexible material that is capable of flexing repeatedly in this manner many times, without significantly losing strength, breaking, or otherwise wearing out. In at least some examples of the invention, the polymeric materials of the mesh or braided panel 122 will produce little to essentially no friction when rubbing against one another during flexion and compression in the manner illustrated in FIG. 7.

Finally, closure systems, securing systems, and/or methods in accordance with examples of this invention are not limited to use with footwear or other foot-receiving devices. Rather, systems and methods in accordance with examples of this invention may be used in other environments, such as in situations where flexibility to shape or position changes is desired in a secured housing device. For example, aspects of the present invention may be used to provide closure systems for other types of apparel.

D. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A foot-receiving device, comprising:

a foot-housing member at least partially defining a chamber for receiving a foot; and a closure system for holding the foot in the foot-housing member, wherein the closure system includes a mesh or braided panel for at least partially holding the foot-receiving device on the foot, wherein the mesh or braided panel at least partially extends around the foot-housing member, over a top instep portion of the foot-housing member from a lateral side of the foot-receiving device to a medial side of the foot-receiving device, and conforms to foot shape or position changes;

wherein the closure system further includes a securing system that keeps the mesh or braided panel proximate to the foot-housing member;

further wherein the securing system includes at least one strap that extends at least partially around a portion of the foot-housing member by extending around a back heel portion of the foot-housing member.

2. A foot-receiving device according to claim 1, wherein the securing system includes at least one portion of a magnetic fastener arrangement.

3. A foot-receiving device according to claim 1, wherein the strap secures to the foot-housing member or to a portion of the closure system.

4. A foot-receiving device according to claim 3, wherein the strap secures via magnetic engagement.

5. A foot-receiving device, comprising:

a foot-housing member at least partially defining a chamber for receiving a foot; and a closure system for holding the foot in the foot-housing member, wherein the closure system includes a mesh or braided panel for at least partially holding the foot-receiving device on the foot, wherein the mesh or braided panel at least partially extends around the foot-housing member, over a top instep portion of the foot-housing member from a lateral side of the foot-receiving device to a medial side of the foot-receiving device, and conforms to foot shape or position changes; and a secondary closure system for holding the foot in the foot-housing member wherein the secondary closure system includes a shoelace based securing system.

6. A foot-receiving device according to claim 5, wherein the mesh or braided panel is a braided panel.

7. A foot-receiving device according to claim 5, wherein the mesh or braided panel includes a plurality of plastic strands wherein the plastic strands each extend from at least one edge of the panel to at least another edge of the panel.

8. A foot-receiving device according to claim 7, wherein the plurality of plastic strands are in a braided arrangement such that the angles of the strands to one another produce open areas between the various strands.

9. A foot-receiving device according to claim 5, wherein the closure system at least partially covers the secondary closure system.

10. A piece of footwear, comprising:

a sole member;

an upper member extending from the sole member and at least partially defining a chamber for receiving a foot; and a closure system for holding the foot in the piece of footwear, wherein the closure system includes a mesh or braided panel for at least partially holding the piece of footwear on the foot, wherein the mesh or braided panel at least partially extends around the upper member, over a top instep portion of the upper member from a lateral side of the piece of footwear to a medial side of the piece of footwear, and conforms to foot shape or position changes, and a secondary closure system for holding the foot in the upper member, wherein the secondary closure system includes a shoelace based securing system, wherein the closure system at least substantially covers the secondary closure system.

11. A foot-receiving device according to claim 10, the mesh or braided panel is substantially continuous panel which completely covers the secondary closure system.

12. A foot-receiving device according to claim 10, wherein the closure system further includes a securing system that keeps the mesh or braided panel proximate to the upper member.

13. A piece of footwear according to claim 12, wherein the securing system includes at least one portion of a magnetic fastener arrangement.

14. A piece of footwear according to claim 12, wherein the securing system includes at least one strap that extends at least partially around a portion of the upper member.

15. A piece of footwear according to claim 14, wherein the strap secures via magnetic engagement.

16. A method for securing a foot-receiving device to a foot, comprising:

inserting a foot through an opening defined in a foot-housing member of a foot-receiving device;

placing a closure system adjacent to at least a portion of the opening, wherein the closure system includes a mesh or braided panel for at least partially holding the foot-receiving device on the foot, wherein the mesh or braided panel at least partially extends around the foot-housing member, over a top instep portion of the foot-housing member from a lateral side of the foot-receiving device to a medial side of the foot-receiving device, and conforms to foot shape or position changes;

securing the closure system to hold the foot in the foot-housing member, and securing the foot-receiving device on the foot using a secondary closure system, wherein the secondary closure system includes a shoelace based securing system, at least substantially covering the secondary closure system with the closure system including the mesh or braided panel.

17. A method according to claim 16, further comprising: completely covering the secondary closure system with the closure system including the mesh or braided panel.

18. A method according to claim 16, wherein the foot-receiving device is a piece of footwear.

19. A method according to claim 16, wherein the securing includes engaging at least one magnetic fastener arrangement.

20. A method according to claim 16, wherein the securing includes extending at least one strap at least partially around a portion of the foot-housing member.

21. A method according to claim 20, wherein the strap forms at least a portion of the closure system and secures to the foot-housing member or to a portion of the closure system.

22. A method according to claim 21, wherein the strap secures via magnetic engagement.

23. A foot-receiving device according to claim 5, wherein the closure system includes a border around the mesh or braided panel, wherein the border is a different material than the mesh or braided panel.

24. A foot-receiving device according to claim 5, the mesh or braided panel is substantially continuous panel which completely covers the secondary closure system.

25. A foot-receiving device according to claim 6, wherein the braided panel includes a plurality of strands in a braided arrangement such that open areas are defined between the strands and further wherein the open areas between the strands contract and expand in response to movement of the foot-receiving device.

* * * * *